US006743994B2

(12) United States Patent
Adachi

(10) Patent No.: US 6,743,994 B2
(45) Date of Patent: Jun. 1, 2004

(54) SLIM SWITCH

(75) Inventor: Hideki Adachi, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/606,781

(22) Filed: Jun. 27, 2003

(65) Prior Publication Data

US 2004/0026222 A1 Feb. 12, 2004

(51) Int. Cl.[7] ..... H01H 1/10
(52) U.S. Cl. ..... 200/512; 200/5 A; 200/517
(58) Field of Search ..... 200/5 A, 512–517

(56) References Cited

U.S. PATENT DOCUMENTS 4,417,294 A * 11/1983 Herron, Jr. ..... 200/517
4,598,181 A * 7/1986 Selby ..... 200/5 A
5,306,886 A * 4/1994 Yamada ..... 200/517
5,697,493 A * 12/1997 Sach et al. ..... 200/314
5,950,808 A * 9/1999 Tanabe et al. ..... 200/314

FOREIGN PATENT DOCUMENTS

JP 9-293430 11/1997 ..... H01H/13/76

* cited by examiner

*Primary Examiner*—Michael A. Friedhofer
(74) *Attorney, Agent, or Firm*—Sughrue Mion, PLLC

(57) ABSTRACT

A circuitry is provided with a first switching contact. A first spacer is laminated on the circuitry so as to provide a first space above the first switching contact. A first, elastic sheet member is laminated on the first spacer and provided with a second switching contact opposing to the first switching contact in the first space. The first sheet member is operable to deform while using the first space to bring the second switching contact into an electrical contact with the first switching contact. A second spacer is laminated on the first sheet member so as to provide a second space above a first part of the first sheet member. A second sheet member is laminated on the second spacer, the second sheet member being operable to deform while using the second space to thereby deform the first part of the first sheet member. An elastic member is interposed between the first sheet member and the second sheet member at the second space. The elastic member has an elastic deformability which is higher than an elastic deformability of the first sheet member.

3 Claims, 4 Drawing Sheets

PRIOR ART

SLIM SWITCH

BACKGROUND OF THE INVENTION

The present invention relates to a slim switch which is employed in operation areas of various apparatuses such as electrical appliances.

A membrane switch, for example, is known as the slim switch. This membrane switch is employed in operation areas of various apparatuses such as electric appliances, because it is highly reliable and contributes to realization of space saving.

In FIG. 3, a membrane switch 51 comprises an exterior sheet 52, a spacer sheet 53 and a circuitry 54, which are laminated on a base plate 55. The respective members are bonded with each other with adhesive layers 56.

A movable contact 57 is provided on a predetermined position of a back face of the exterior sheet 52. A through hole 58 is formed in the spacer sheet 53 in alignment with the position of the movable contact 57. The circuitry 54 is provided with a switch circuit having an appropriate pattern, which is not shown. Fixed contacts 59 are provided on the switch circuit at positions opposed to the movable contact 57.

In the membrane switch 51 having the above described structure, when a front face of the exterior sheet 52 is pressed downward with switch operation of a finger 60 of an operator, as shown by an arrow mark, the movable contact 57 and the fixed contacts 59 are brought into electrical contact with each other in association with flexure of the exterior sheet 52. In this manner, the conductive condition of the non-shown switch circuit is established. On the other hand, when the finger 60 of the operator is detached from the membrane switch 51, the exterior sheet 52 which is flexed until then will be recovered to the original state, and the conductive condition of the switch circuit will be released.

Besides the above described membrane switch 51, a dome switch having the following structure is commonly used as the slim switch.

In FIGS. 4 and 5, a dome switch 61 comprises an exterior sheet 62, a spacer sheet 63 and a circuitry 64 which are laminated on a base plate 65. The respective members are bonded to each other with adhesive layers 66. Moreover, the dome switch 61 is designed in such a manner that more improved feeling of click as compared with the above described membrane switch 51 (see FIG. 3) can be obtained.

The exterior sheet 62 is formed with a dome part 67 which is projected in a dome shape. A movable contact 68 is provided at the top of a back face of the dome part 67. A through hole 69 is formed in the spacer sheet 63 at a position corresponding to the dome part 67. Into this through hole 69, the dome part 67 which is projected downward is adapted to be inserted. The circuitry 64 is provided with a not-shown switch circuit with an appropriate pattern. Fixed contacts 70 are provided on the switch circuit at positions opposed to the movable contact 68.

In the dome switch 61 having the above described structure, when the dome part 67 is pressed downward with switch operation of a finger 71 of an operator as shown by an arrow mark, and the movable contact 68 of the dome part 67 which is projected downward comes into electrical contact with the fixed contacts 70 of the circuitry 64, the conductive condition of the non-shown switch circuit can be obtained. When the dome part 67 is projected downward, the feeling of click can be obtained. On the other hand, when the finger 71 of the operator is detached from the dome part 67, the dome part 67 which is projected downward until then will be recovered to the original state, and the conductive condition of the non-shown switch circuit will be released.

The above described membrane switch 51 and the dome switch 61 have had several problems as follows.

First, there is a problem that it is difficult to secure a sufficient stroke length when the switch is operated. There is such an anxiety that a person who operates the switch is unable to reliably recognize ON-OFF of the switch.

Second, there is a problem that operation load of the switch operation is determined to some extent, depending on a shape of the part to be pressed, and it is actually difficult to change feeling of the switch operation even if so desired. Third, there is another problem that freeness of design is limited due to the shape of the part to be pressed.

Lastly, in the dome switch 61, when the dome part 67 which is projected downward is recovered to the original state, speed of the recovery may be faster than speed of the finger 71 to be detached. Therefore, there is a problem that some of the operators may feel uncomfortable when they receive a repulsive force of the dome part 67.

SUMMARY OF THE INVENTION

It is therefore an object of the invention to provide a slim switch in which a sufficient stroke length at the switch operation can be secured, and improved feeling of the switch operation can be obtained. It is also an object of the invention to provide a slim switch in which freeness of design can be enhanced.

In order to achieve the above object, according to the invention, there is provided a switch, comprising:

- a circuitry, provided with a first switching contact;
- a first spacer, laminated on the circuitry so as to provide a first space above the first switching contact;
- a first, elastic sheet member, laminated on the first spacer and provided with a second switching contact opposing to the first switching contact in the first space, the first sheet member being operable to deform while using the first space to bring the second switching contact into an electrical contact with the first switching contact;
- a second spacer, laminated on the first sheet member so as to provide a second space above a first part of the first sheet member;
- a second sheet member, laminated on the second spacer, the second sheet member being operable to deform while using the second space to thereby deform the first part of the first sheet member; and
- an elastic member, interposed between the first sheet member and the second sheet member at the second space, the elastic member having an elastic deformability which is higher than an elastic deformability of the first sheet member.

In such a configuration, when the switch is operated, the second sheet member is first subjected to a pressure load and deformed, and at the same time, the elastic member is elastically deformed. Then, the first part of the first sheet member is deformed downward, so that the second switching contact is brought into contact with the first switching contact. With this action, the switch is turned on. On the other hand, when the pressure load is released, the first part of the first sheet member deformed downward, the elastic member elastically deformed, and the second sheet member deformed downward are recovered to their original state, and the conductive condition of the switch is released. On this occasion, a repulsive force of the first part of the first sheet member is absorbed by the elastic member.

Accordingly, not only a sufficient stroke length can be secured, but also the freeness of design of the second sheet member serving as an exterior appearance member can be enhanced. Further, the feeling at the switch operation can be improved.

Preferably, the static member is fixed to at least one of faces of the first sheet member and the second sheet member which are opposed to each other through the second space.

In such a configuration, since distance between the first sheet member and the second sheet member is kept constant, the stroke length can be always secured in a stabilized state. Moreover, the feeling at the switch operation can be maintained in a favorable condition.

Preferably, the first part of the first sheet member is projected toward the second sheet member in a condition where no load is applied thereto.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

One preferred embodiment of the invention will be described with reference to the accompanying drawings.

Figure 1:
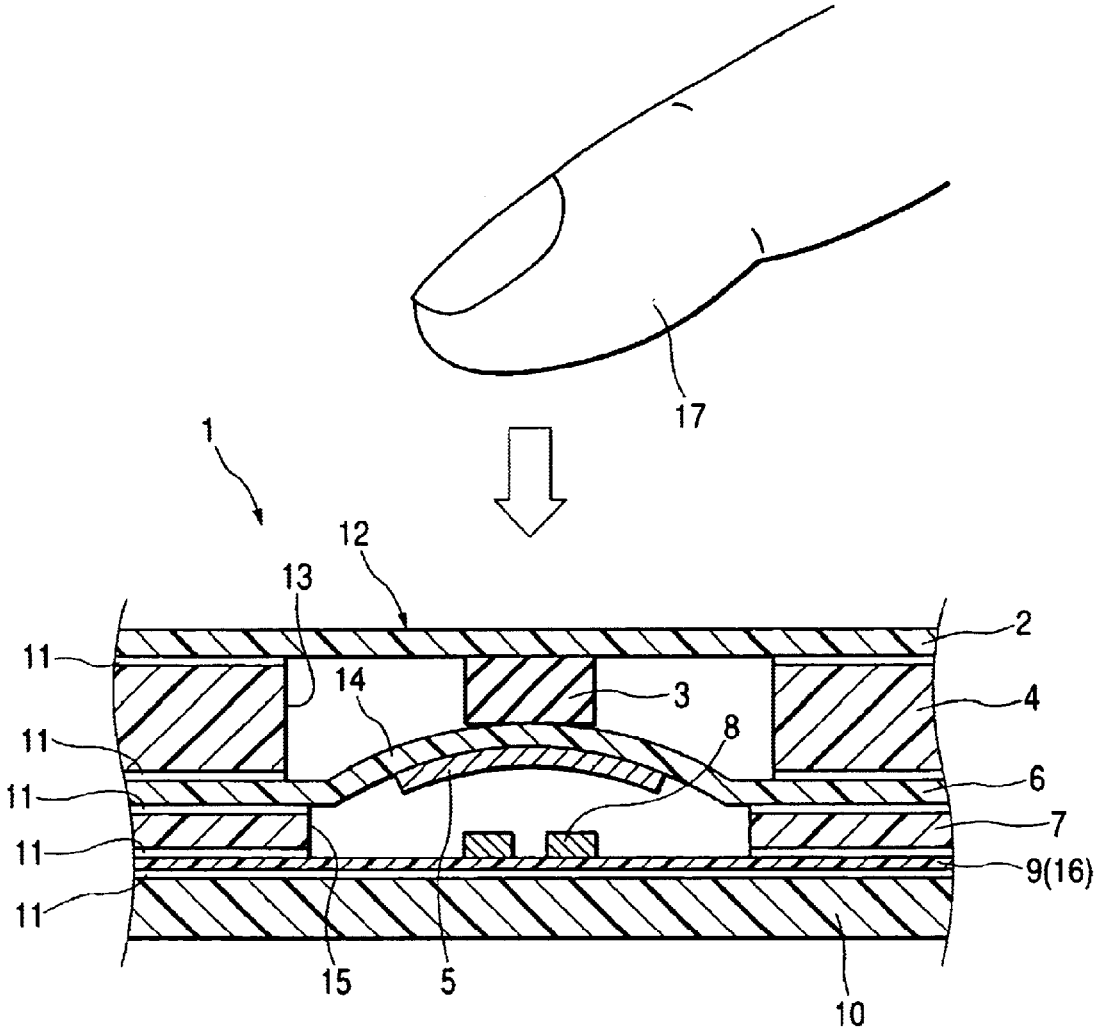
FIG. 1 is a sectional view showing a slim switch according to one embodiment of the invention.

As shown in FIG. 1, a slim 1 comprises an exterior sheet 2, an elastic member 3, a second spacer 4, a dome sheet 6 having a movable contact 5, a first spacer 7, and a circuitry 9 having fixed contacts 8 which are laminated and fixed on a base plate 10 in this order from outside. The respective components are bonded to each other with adhesive layers 11.

The exterior sheet 2 is a thin-walled sheet member having flexibility and made of synthetic resin including polyethylene terephthalate (PET), or polyethylene naphthalate (PEN), for example. In this embodiment, the exterior sheet 2 is formed in such a manner that desired exterior-appearance design may be provided on an entire surface thereof.

The elastic member 3 is fixed to a predetermined position on a back face of the exterior sheet 2 by adequate fixation means (adhesive agent, for example). An area within a periphery of the predetermined position on the exterior sheet 2 is deemed as a switch operation part 12, which is adapted to be flexed downward (in a direction of an arrow mark).

The elastic member 3 is formed of rubber, elastomer, for example, and can be elastically deformed in a direction of compression. The elastic member 3 has such a length as bridging between the back face of the exterior sheet 2 and a front face of a dome part 14 of the dome sheet 6 which will be described below, and is formed in a shape of pillar. An upper end of the elastic member 3 is fixed to the back face of the exterior sheet 2, as described above. A lower end of the elastic member 3 is in contact with the surface of the dome part 14, or fixed thereto by employing adequate fixation means (adhesive agent, for example) in the same manner as the upper end. The elastic member 3 has such flexibility that it may be elastically deformed earlier than the below described dome part 14, in response to a pressure load received by the surface of the exterior sheet 2 (pressure load received by the switch operation part 12). The elastic member 3 may be formed of sponge or spring, other than the above described material).

The second spacer 4 is a sheet member made of synthetic resin including polyethylene terephthalate (PET), or polyethylene naphthalate (PEN) for example, and provided for the purpose of preventing deformation of the exterior sheet 2 and securing a stroke length of the exterior sheet 2. The adhesive layers 11 are respectively provided on a front face and a back face of the second spacer 4 so that the exterior sheet 2 and the dome sheet 6 can be respectively fixed to the above mentioned front and back faces. This second spacer 4 has a through hole 13 which is formed in alignment with the position of the switch operation part 12 of the exterior sheet 2, and in correspondence with dimension of the dome part 14.

The dome sheet 6 is a sheet member made of synthetic resin including polyethylene terephthalate (PET), or polyethylene naphthalate (PEN) for example, and has at least one dome part 14 formed by applying heat press. This dome part 14 is formed in a dome shape which is projected toward a front face side of the exterior sheet 2 and can be projected downward toward a back face side thereof. The movable contact 5 is provided on the back face of the dome part 14 (not necessarily limited to this position). This movable contact 5 is made of carbon or the like and provided at the top of the back face of the dome part 14 by printing, for example. A lower end of the elastic member 3 is in contact with the top of the front face of the dome part 14 or may be fixed thereto.

The first spacer 7 is a sheet member made of synthetic resin including polyethylene terephthalate (PET), or polyethylene naphthalate (PEN) for example, and provided for the purpose of preventing deformation of the dome sheet 6, allowing air to escape while the dome part 14 is projected downward, and securing a stroke length of the dome part 14. The adhesive layers 11 are respectively provided on a front face and a back face of the first spacer 7 so that the dome sheet 6 and the circuitry 9 can be respectively fixed to the front and back faces of the first spacer 7.

This first spacer 7 has a through hole 15 which is formed in alignment with the position of the dome part 14, and an air escape port which is not shown. The through hole 15 is formed so as to have a larger diameter than a diameter of the dome part 14. However, the diameter of the through hole 15 may be equal to the diameter of the dome part 14. Moreover, the size of the through hole 15 is equal to or smaller than the size of the through hole 13. The dome part 14 which is projected downward is adapted to be inserted into the through hole 15.

The circuitry 9 is constructed by employing an FPC (a flexible printed circuit) in this embodiment. A known printed circuit board (PCB) may be also employed. Moreover, the circuitry 9 comprises a main body 16 of the circuitry having a not-shown switch circuit arranged in a desired pattern, and a not-shown exterior connecting section to which an exterior apparatus is electrically connected.

The main body 16 of the circuitry is provided with the fixed contacts 8 which are opposed to the movable contact 5. The adhesive layer 11 is provided on the back face of the main body 16 of the circuitry. This adhesive layer 11 is provided for the purpose of fixing the slim switch 1 to the base plate 10. The exterior connecting section comprises a wiring circuit drawn out from the main body 16 of the circuitry 9, and edge connector terminals or connectors, for example, which are provided at a distal end of the wiring circuit.

The base plate 10 is a hard plate member made of synthetic resin for example, and the circuitry 9 is fixed to the front face of the base plate 10 with the adhesive layer 11 interposed therebetween.

One example of an assembling method of the slim switch 1 having the above described structure will be described. As a first step, the exterior sheet 2, having the elastic member 3 provided in advance at the predetermined position on the back face thereof, is fixed by bonding to the front face of the second spacer 4. Then, the dome sheet 6 is fixed by bonding to the front face of the first spacer 7, while the circuitry 9 is fixed by bonding to the back face of the first spacer 7. These members are fixed by bonding to the back face of the second spacer 4 from the side of the dome sheet 6 thereby to assemble the slim switch 1. Then, the slim switch 1 which is assembled in this manner is fixed by bonding to the base plate 10 from the side of the circuitry 9, and will be operated as follows. A drawing showing an operated state of the slim switch 1 is omitted.

In a state prior to the switch operation in which no load is applied to the switch operation part 12, the exterior sheet 2, the elastic member 3 and the dome part 14 are maintained in their original shape due to shape retaining properties of themselves. When the switch is operated, and the switch operation part 12 of the exterior sheet 2 is pressed by an operator's finger 17 in the direction of the arrow mark, the exterior sheet 2 is first flexed downward, and simultaneously, the elastic member 3 is elastically deformed in the direction of compression. Then, the dome part 14 is flexed with the exterior sheet 2 and the elastic member 3, while resisting against the load applied by the pressure of the finger 17, and will be projected downward when the load reaches at a certain amount. The feeling of click will be created on this occasion.

When the dome part 14 is flexed and projected downward, the load in the downward direction will be decreased, and the dome part 14 will smoothly proceed to be pressed. The further pressed dome part 14 is inserted into the through hole 15 of the first spacer 7, so that the movable contact 5 provided in the dome part 14 is brought into contact with the fixed contacts 8 on the circuitry 9.

With this action, the conductive condition of the not-shown switch circuit on the circuitry 9 is established, so that the slim switch 1 is turned on. On the other hand, when the finger 17 is detached to remove the load in the downward direction, the dome part 14, the elastic member 3 and the exterior sheet 2 are recovered to the original state. A repulsive force of the dome part 14 is absorbed by the elastic member 3. Along with this action, the conductive condition is released so that the slim switch 1 is turned off.

Figure 2:
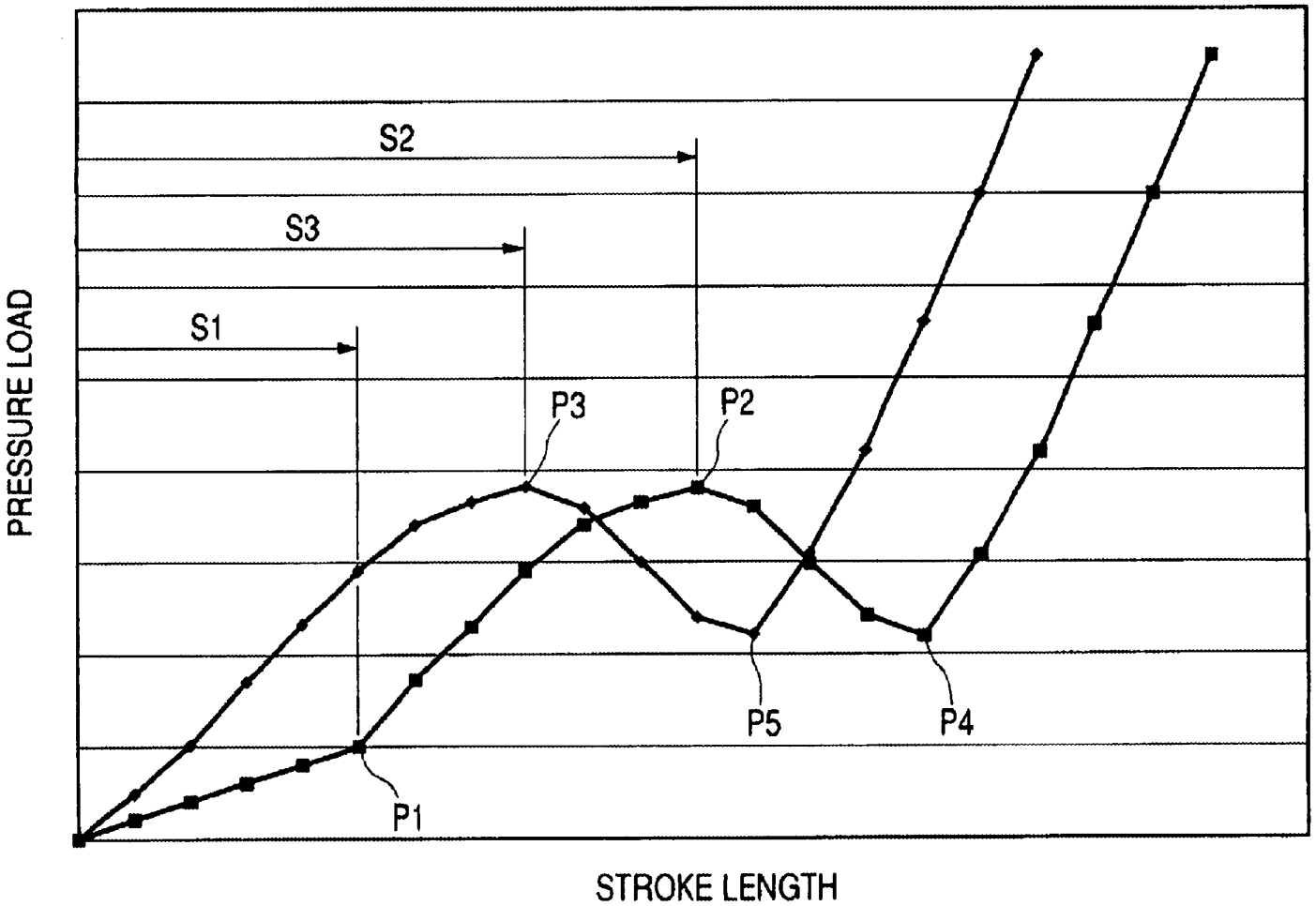
FIG. 2 is a graph showing a pressure-stroke curve of the slim switch.
Figure 3:
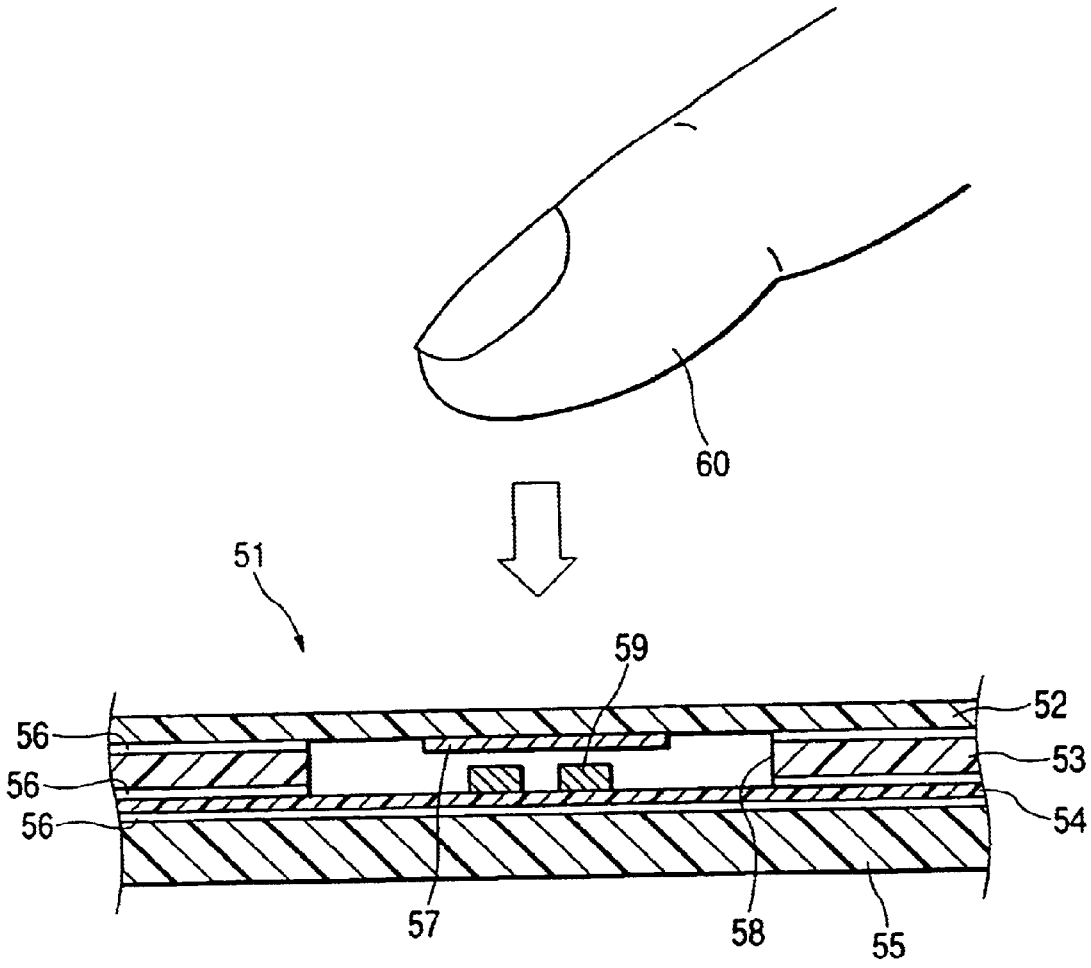
FIG. 3 is a sectional view of a related-art membrane switch.
Figure 4:
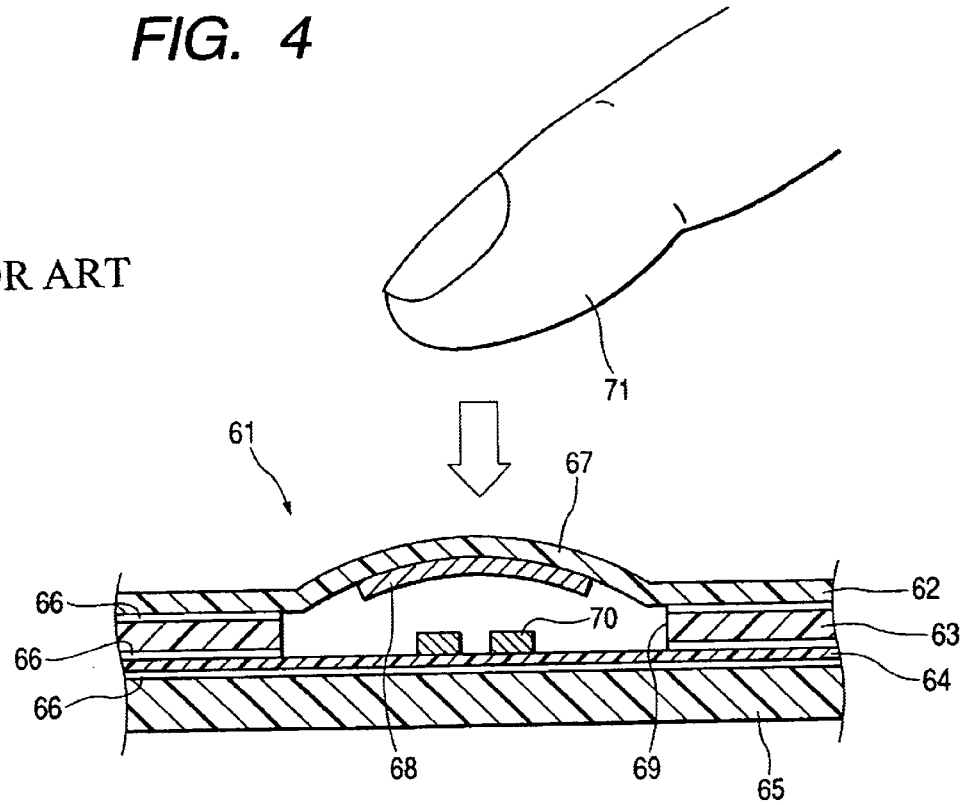
FIG. 4 PRIOR ART
FIG. 4 is a sectional view of a related-art dome switch.
Figure 5:
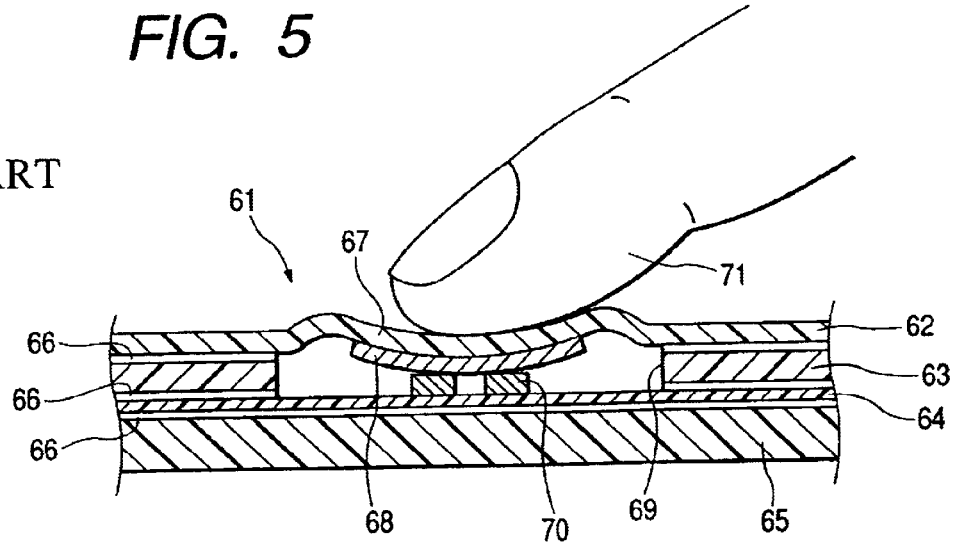
FIG. 5 PRIOR ART
FIG. 5 is a sectional view of the related-art dome switch, showing an operated state.

In FIG. 2, an axis of ordinates represents the pressure load and an axis of abscissas represents the stroke length. The curve having square dots represents the pressure-stroke curve of the slim switch 1, while the curve having circular dots represents the pressure-stroke curve of the related-art dome switch 61 shown in FIGS. 4 and 5.

When the switch is operated, the slim switch 1 is deformed with a lower load than the dome switch 61, during a period (S1) while the exterior sheet 2 is flexed downward, and the elastic member is elastically deformed sufficiently in the direction of compression. After an inflection point P1, the curve of the slim switch 1 runs substantially in parallel to the curve of the dome switch 61, and arrives at a reverse point P2 of the dome part 14. On this occasion, a stroke S2 of the slim switch 1 up to the reverse point P2 of the dome part 14 is longer than a stroke S3 of the dome switch 61 up to a reverse point P3 of the dome part 67. Thereafter, the load decreases by the downward flection of the dome part, and the curves arrive at contact points P4, P5 where the contacts come into contact with each other.

As is described above referring to FIGS. 1 and 2, in the slim switch 1 according to the invention, due to the particular arrangement of the dome part 14, the elastic member 3 and the exterior sheet 2, the stroke length corresponding to the flexure of the exterior sheet 2 and the elastic deformation of the elastic member 3, and the stroke length corresponding to the downward flection of the dome part 14 can be secured as the stroke lengths at the switch operation longer than in the related-art switches. Also due to the above described particular arrangement, the freeness of design can be enhanced. Further, due to presence of the elastic member 3 and the exterior sheet 2, the feeling of the switch operation can be improved.

Although the present invention has been shown and described with reference to one specific preferred embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. A switch, comprising:

a circuitry, provided with a first switching contact;

a first spacer, laminated on the circuitry so as to provide a first space above the first switching contact;

a first, elastic sheet member, laminated on the first spacer and provided with a second switching contact opposed to the first switching contact in the first space, the first sheet member being operable to deform while using the first space to bring the second switching contact into an electrical contact with the first switching contact;

a second spacer, laminated on the first sheet member so as to provide a second space above a first part of the first sheet member;

a second sheet member, laminated on the second spacer, the second sheet member being operable to deform while using the second space to thereby deform the first part of the first sheet member; and an elastic member, interposed between the first sheet member and the second sheet member at the second space, the elastic member having an elastic deformability which is higher than an elastic deformability of the first sheet member.

2. The switch as set forth in claim 1, wherein the elastic member is fixed to at least one of faces of the first sheet member and the second sheet member which are opposed to each other through the second space.

3. The switch as set forth in claim 1, wherein the first part of the first sheet member is projected toward the second sheet member in a condition where no load is applied thereto.

* * * * *

UNITED STATES PATENT AND TRADEMARK OFFICE

CERTIFICATE OF CORRECTION

PATENT NO. : 6,743,994 B2
DATED : June 1, 2004
INVENTOR(S) : Hideki Adachi

It is certified that error appears in the above-identified patent and that said Letters Patent is hereby corrected as shown below:

Title page,
Insert Item:

-- [30] Foreign Application Priority Data

June 27, 2002 (JP) P2002-187232 --

Signed and Sealed this

Seventh Day of December, 2004

JON W. DUDAS
*Director of the United States Patent and Trademark Office*